United States Patent [19]

Nerheim

[11] 4,422,075

[45] Dec. 20, 1983

[54] PROXIMITY MONITOR

[75] Inventor: Eldon Nerheim, Hopkins, Minn.

[73] Assignee: Honeywell Inc., Minneapolis, Minn.

[21] Appl. No.: 265,880

[22] Filed: May 21, 1981

[51] Int. Cl.[3] ..... G01S 13/86; F42C 13/04

[52] U.S. Cl. ..... 343/6 R; 102/212; 102/214; 343/5 PD; 343/7 PF

[58] Field of Search ..... 102/212, 214; 343/5 PD, 343/6 R, 7 PF

[56] References Cited

U.S. PATENT DOCUMENTS

| | | | |
|---|---|---|---|
| 3,026,805 | 3/1962 | Becker | 102/212 |
| 3,902,172 | 8/1975 | Weiss et al. | 102/214 X |
| 3,913,485 | 10/1975 | Holmes et al. | 343/7 PF X |
| 3,942,447 | 3/1976 | Van Orsdel . | |
| 4,185,560 | 6/1980 | Levine . | |
| 4,193,072 | 3/1980 | McKusick | 102/214 X |
| 4,368,460 | 1/1983 | Clinard et al. | 343/5 PD X |

FOREIGN PATENT DOCUMENTS

| | | | |
|---|---|---|---|
| 66168 | 12/1982 | European Pat. Off. | 102/214 |
| 2831420 | 1/1980 | Fed. Rep. of Germany | 102/214 |
| 2342626 | 1/1982 | France . | |
| 2052021 | 1/1981 | United Kingdom | 102/212 |
| 2063430 | 6/1981 | United Kingdom | 102/214 |

*Primary Examiner*—T. H. Tubbesing

*Attorney, Agent, or Firm*—George W. Field

[57] ABSTRACT

A proximity monitor for movement at a selected distance from a surface, including a first microwave sensor having an antenna pattern directed toward the surface, the principal component of the pattern parallel to the surface being in the direction of the movement, a second microwave sensor having a second antenna pattern directed toward the surface, the principal component of the second pattern parallel to the surface being at a direction opposite to that of the movement, and the patterns being mutually spaced at the surface in the direction of movement, a magnetic anomaly sensor giving an output representative of the presence at the surface of a magnetic anomaly located between the patterns, and apparatus connected to the sensors for performing a control function when the signals from the sensors are above predetermined levels in a predetermined time relationship.

2 Claims, 3 Drawing Figures

PROXIMITY MONITOR

TECHNICAL FIELD

This invention relates to the field of electronics, and particularly to a proximity monitor for movement at a distance from the earth's surface and detecting the presence of a military target on the surface below the monitor.

BACKGROUND OF THE INVENTION

One of the attack modes currently in military use is to discharge a projectile with a very flat trajectory, directed in azimuth to pass over a target, and then firing the projectile warhead when it is over the target. Top attack on targets such as tanks is desirable, since the top armor is usually thinner, the presented area is larger, the profile is flatter, and the engine of the vehicle is more vulnerable. The problem is to determine when the projectile has reached a point directly over the target.

BRIEF SUMMARY OF THE INVENTION

The present invention comprises a monitor having three channels including two microwave sensors and one magnetic anomaly sensor or magnetometer. The microwave sensors have their antenna patterns directed forwardly and rearwardly along the projectile path, and do not quite overlap at the surface, while the magnetometer is non-directional. The sensor signals are combined, with suitable time modifications, so that when all reach a control at the same time the projectile is directly over the target and firing is triggered.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawings, in which like reference numerals indicate corresponding parts throughout the several views.

DESCRIPTION OF THE PREFERRED EMBODIMENT

Figure 1:
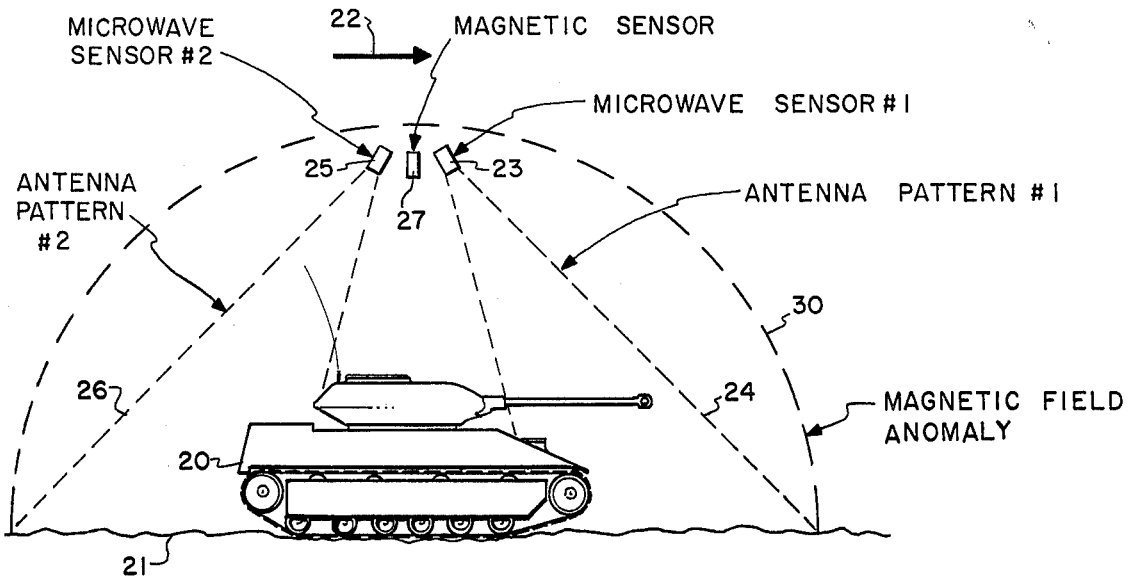
FIG. 1 shows the invention in operation.

Referring first to FIG. 1, a military target 20, shown as a tank, has been detected on the earth's surface 21 and a projectile has been fired in an azimuth which passes over the target. The trajectory of the projectile is very flat, as indicated by the arrow 22 and the projectile carries a first microwave sensor 23 having a downward antenna pattern 24 directed forwardly of the path of the projectile, a second microwave sensor 25 having a downward antenna pattern 26 directed rearwardly, and a magnetic anomaly sensor or magnetometer 27 which is non-directional. The antenna patterns do not overlap at the surface of the earth, but are mutually spaced. The anomally caused by target 20 is roughly spherical about the target, as suggested at 30.

Figure 2:
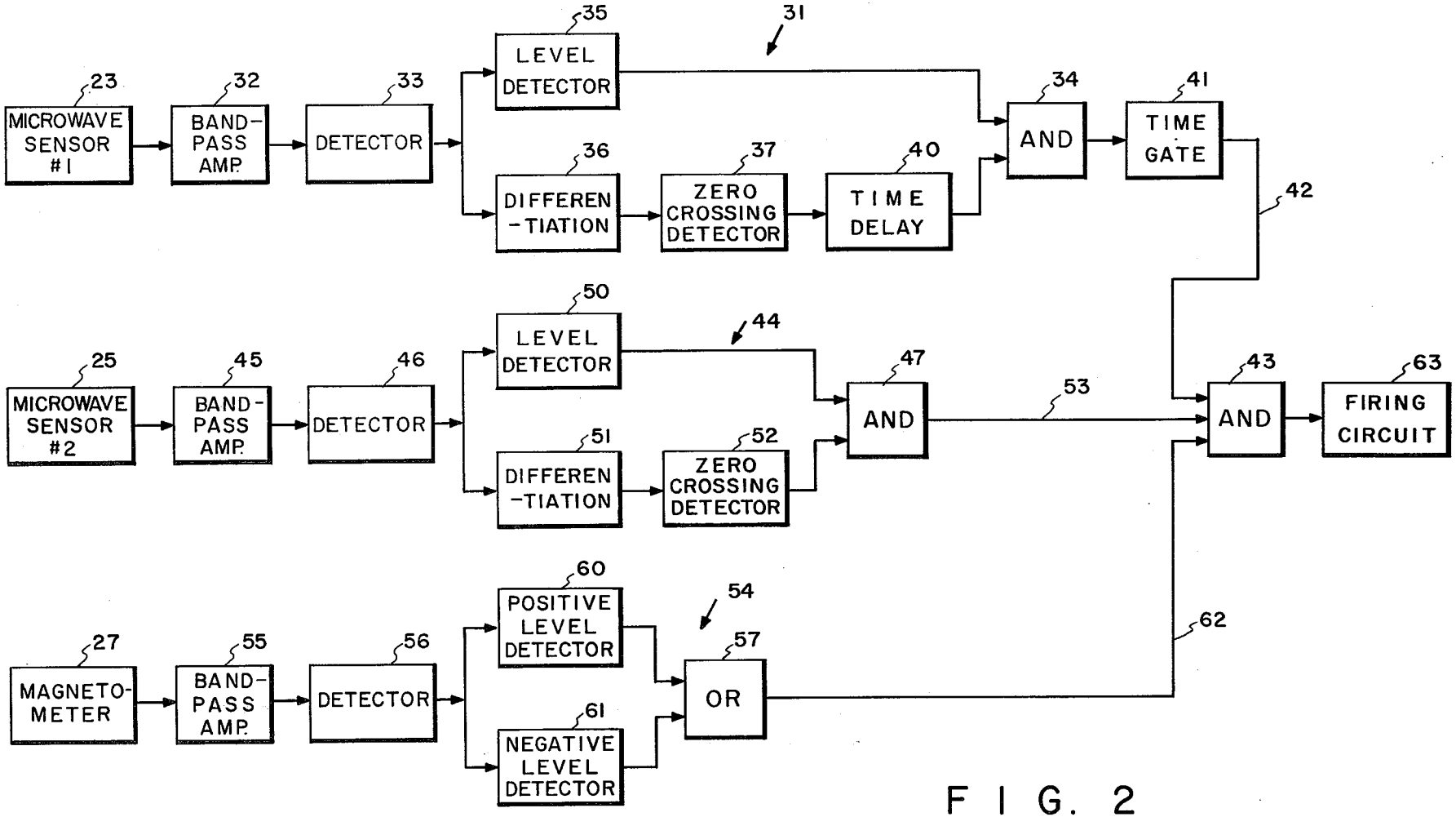
FIG. 2 is a block diagram of the system.

FIG. 2 shows that the monitor is made up of three channels, one for each microwave sensor and one for the magnetometer. In the first channel 31 the output of sensor 23 is fed through a band-pass amplifier 32 to a detector 33, the output of which is fed to a double input AND gate 34, both through a level detector 35 and through a differentiator 36, a zero crossing detector 37, and a time delay 40. The output of AND gate 34 turns on a time gate 41 for a predetermined interval, to provide a first input 42 to a triple input AND gate 43.

In the second channel 44 the output of sensor 25 is fed through a band pass amplifier 45 to a detector 46, the output of which is fed to a double input AND gate 47, both through a level detector 50 and through a differentiator 51 and a zero crossing detector 52. The output of AND gate 47 is fed as a second input 53 to AND gate 43.

In the third circuit 54 the output of magnetometer 27 is fed through a band pass filter 55 to a detector 56, the output of which is fed to a double input OR gate 57 through both a positive level detector 60 and a negative level detector 61. The output of OR gate 57 is fed as a third input 62 to AND gate 43, which is connected to energize a firing circuit 63.

Sensors 23 and 25 operate preferably in the range between 18 and 35 GHz, or higher. Since their beams are not vertical, they develop doppler signals.

OPERATION

Figure 3:
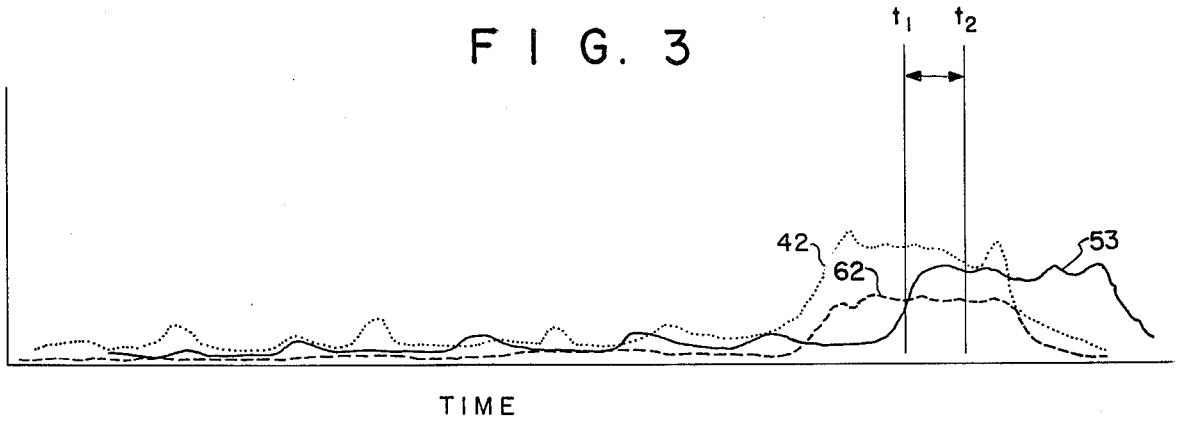
FIG. 3 shows signals appearing in the system.

Operation of the monitor will now be explained referring particularly to FIG. 3, which shows the relationship in time between inputs 42, 53, and 62 to AND gate 43.

As the projectile approaches the target, microwave sensor 23 develops an output, in channel 31, which is band-pass amplified at 32 and detected at 33 to optimize further signal processing. When the signal reaching level detector 35 exceeds the threshold of the detector, a first input is supplied to AND gate 34. The signal is also differentiated at 36 and applied to zero crossing detector 37 so that when the sensor signal begins to decrease, time delay 40 is turned on and after its fixed delay a second signal is supplied to AND gate 34, which results in turning on time gate 41. After its period is satisfied, a signal is supplied at 42 to AND gate 43. This signal is as shown in FIG. 3.

A signal starts to be supplied by magnetometer 27 in channel 54, at about the same time as that from sensor 23, and is band-pass amplified at 55 and detected at 56 for improved signal processing. The magnetic signature wave shape is expected to be of various shapes due to magnetic differences in targets, locations on the earth's surface, and so on, and may be either a positive going or a negative going change. Such changes can be detected either by detector 60 or by detector 61 an output from either energizes OR gate 57 to supply a signal at 62 to AND gate 43. This signal is suggested in FIG. 3.

As the projectile continues in flight, sensor 25 develops an output in channel 44, which is band-pass filtered at 45 and detected at 46, again for improved signal processing. This channel, like channel 54, does not contain any time delay, so the signal is supplied directly as a third input 53 to AND gate 43. As shown in FIG. 3, there is an interval $t_1-t_2$ during which delayed signal 42 and signals 62 and 53 are all above the thresholds of the level detectors: between time $t_1$ and $t_2$ AND gate 43 supplies a signal to firing circuit 63.

Localization of the target is achieved when one microwave sensor detects one edge of the target and the other microwave sensor detects the other edge of the target, while the magnetic sensor detects a gross change in the earth's magnetic field.

From the foregoing it will be evident the invention comprises a proximity monitor having first and second microwave sensors with oblique antenna patterns and a magnetometer sensing anomalies in the earth's field, so that when the signals from the sensors are suitably processed they exceed threshold values simultaneously to perform a control function, such as causing a projectile to fire.

Numerous characteristics and advantages of the invention have been set forth in the foregoing description, together with details of the structure and function of the invention, and the novel features thereof are pointed out in the appended claims. The disclosures, however, is illustrative only, and changes may be made in detail especially in matters of shape, size, and arrangement of parts, within the principle of the invention to the full extent indicated by the broad general meaning of the terms in which the appended claims are expressed.

I claim:

1. In a proximity monitor for movement at a selected distance from a surface, in combination:

a first microwave sensor having an antenna pattern directed toward said surface, the principal component of said pattern parallel to said surface being in the direction of said movement;

a second microwave sensor having a second antenna pattern directed toward said surface, the principal component of said second pattern parallel to said surface being in a direction opposite to that of said movement, said patterns being mutually spaced, at said surface, in said direction of movement;

a magnetic anomaly sensor giving an output representative of the presence at said surface of a magnetic anomaly located between said patterns; and means connected to said sensors, including time delay means connected to said first sensor, for performing a control function when the signals from said sensors are above predetermined levels in a predetermined time relationship.

2. A proximity monitor comprising, in combination; a first channel including a first microwave sensor, a first detector, means including a first band-pass amplifier connecting said first sensor to said first detector, a first level detector and first differentiator connected to said first detector, a first AND gate, means connecting said first level detector to supply a first input to said first AND gate, means including a first zero crossing detector and a time delay circuit connecting said first differentiator to supply a second input to said first AND gate, and a time gate connected for actuation by said first AND gate;

a second channel including a second microwave sensor, a second detector means including a second band-pass amplifier connecting said second sensor to said second detector, a second level detector and a second differentiator connected to said second detector, a second AND gate, means connecting said second level detector to supply a first signal to said second AND gate, and means including a second zero crossing detector connecting said second differentiator to supply a second signal to said second AND gate;

a third channel including a magnetometer, a third detector, means including a third band-pass amplifier connecting said magnetometer to said detector, positive and negative level detectors connected to said third detector, and an OR gate connected to said positive and negative level detectors;

a third AND gate; and means connecting said time gate said second AND gate and said OR gate to said third AND gate; and control means connected to said third AND gate.

* * * * *